US007210440B2

(12) United States Patent
Lawrence et al.

(10) Patent No.: US 7,210,440 B2
(45) Date of Patent: May 1, 2007

(54) CAMSHAFT ASSEMBLY

(75) Inventors: Nicholas James Lawrence, Buckingham (GB); Richard Alwyn Owen, Banbury (GB); Timothy Mark Lancefield, Shipston on Stour (GB); Ian Methley, Witney (GB)

(73) Assignee: Machadyne PLC, Kirtlington (GB)

( * ) Notice: Subject to any disclaimer, the term of this patent is extended or adjusted under 35 U.S.C. 154(b) by 0 days.

(21) Appl. No.: 11/372,764

(22) Filed: Mar. 10, 2006

(65) Prior Publication Data

US 2006/0207529 A1 Sep. 21, 2006

(30) Foreign Application Priority Data

Mar. 16, 2005 (GB) ..... 0505296.4

(51) Int. Cl.
*F01L 1/04* (2006.01)

(52) U.S. Cl. ..... 123/90.6; 123/90.17; 74/567

(58) Field of Classification Search ..... 123/90.6, 123/90.17, 90.18; 74/567
See application file for complete search history.

(56) References Cited

U.S. PATENT DOCUMENTS 4,332,222 A * 6/1982 Papez ..... 123/90.17
5,402,759 A * 4/1995 Ding et al. ..... 123/182.1

* cited by examiner

*Primary Examiner*—Thomas Denion
*Assistant Examiner*—Zelalem Eshete
(74) *Attorney, Agent, or Firm*—Smith-Hill and Bedell

(57) ABSTRACT

A camshaft assembly includes an inner shaft, an outer tube surrounding and rotatable relative to the inner shaft, and two groups of cam lobes mounted on the outer tube. The first group of cam lobes is fast in rotation with the outer tube and the second group is rotatably mounted on the outer tube and connected for rotation with the inner shaft by means of pins that pass with clearance through slots in the outer tube. A spring is incorporated in the camshaft assembly to bias the inner shaft relative to the outer tube towards one extreme of its angular range.

21 Claims, 4 Drawing Sheets

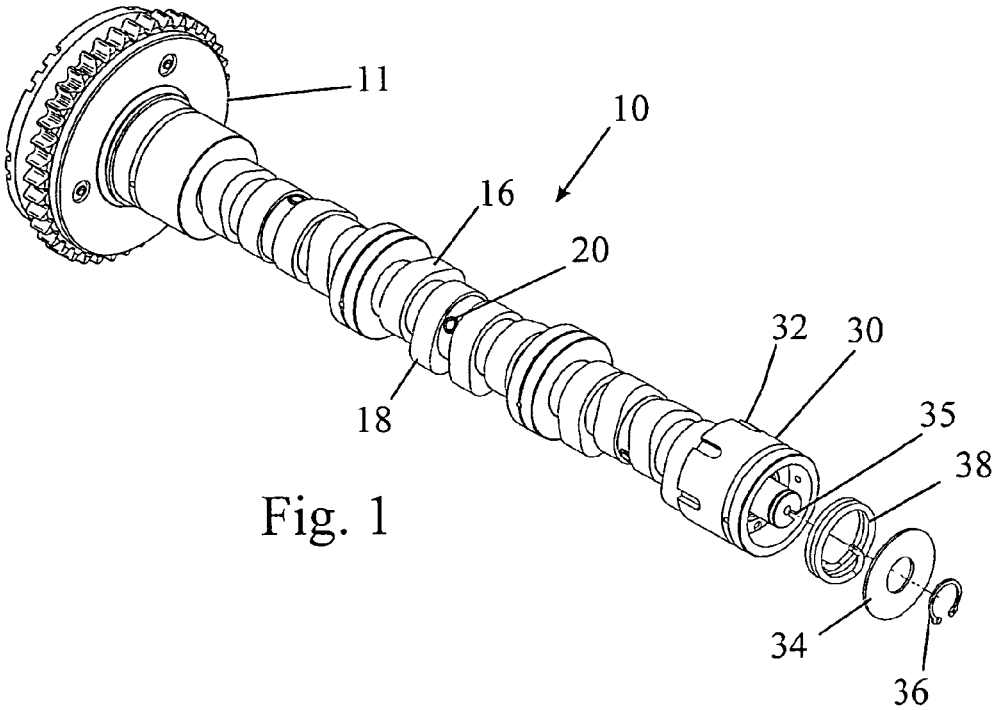
Fig. 1
Fig. 2A
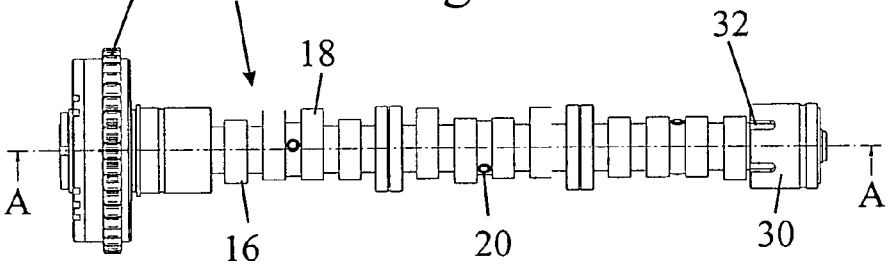
Fig. 2B
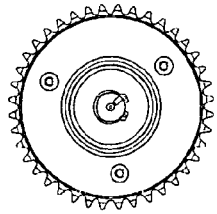
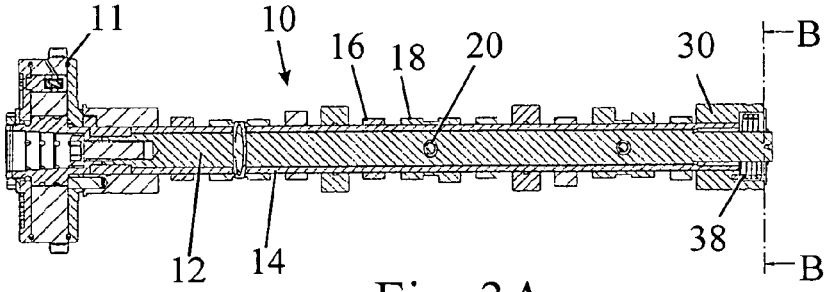
Fig. 3A
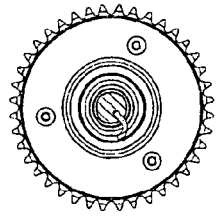
Fig. 3B

CAMSHAFT ASSEMBLY

CROSS REFERENCE TO RELATED APPLICATION

This application claims priority under 35 USC 119 of United Kingdom Patent Application No. 0505296.4 filed Mar. 16, 2006.

FIELD OF THE INVENTION

The present invention relates to a camshaft assembly comprising an inner shaft, an outer tube surrounding and rotatable relative to the inner shaft, and two groups of cam lobes mounted on the outer tube, the first group of cam lobes being fast in rotation with the outer tube and the second group being rotatably mounted on the outer surface of the tube and connected for rotation with the inner shaft by means of pins that pass with clearance through slots in the outer tube.

BACKGROUND OF THE INVENTION

An adjustable camshaft assembly as set forth above, herein also termed an SCP (single cam phaser) camshaft, allows variable valve timing to be implemented in engines having different valves operated by lobes on the same camshaft. A phaser mounted on one end of the SCP camshaft allows the inner shaft and/or the outer tube to be rotated relative to a crankshaft driven pulley to permit the timing of at least one of the two groups of cam lobes to be altered in relation to the crankshaft timing.

There are numerous known types of phase change mechanisms, or phasers, some of which, for example vane-type phasers, are hydraulically operated. Within such phasers intended for use with a solid camshaft, it is known to incorporate a spring to bias the phaser into an extreme end position, to enable the engine to start and idle correctly while there is still insufficient oil pressure to operate the phaser. An example of such a phaser is described in US 2003/0217718.

OBJECT OF THE INVENTION

A problem is however encountered in the prior art in finding sufficient space within a phaser to accommodate a spring to bias the inner shaft of an SCP camshaft relative to the outer tube, bearing in mind that there are severe constraints on the overall size of the phaser.

SUMMARY OF THE INVENTION

With a view to mitigating the foregoing disadvantages, the present invention provides a camshaft assembly comprising an inner shaft, an outer tube surrounding and rotatable relative to the inner shaft, and two groups of cam lobes mounted on the outer tube, the first group of cam lobes being fast in rotation with the outer tube and the second group being rotatably mounted on the outer tube and connected for rotation with the inner shaft by means of pins that pass with clearance through slots in the outer tube, wherein a compliant member is incorporated in the camshaft assembly to bias the inner shaft relative to the outer tube towards one extreme of its angular range.

In the invention, the spring biasing the components of an SCP camshaft into a position suitable for starting the engine forms part of the camshaft not the phaser driving the camshaft. As will be clear from the ensuing description, there are numerous suitable locations for such a spring on the camshaft that do not create the packaging problems that occur when attempting to integrate such a spring into the phaser.

The compliant member, which is preferably a spring, may suitably be connected to the outer tube via a camshaft bearing, a camshaft lobe or a sensor ring.

The compliant member may be connected to the inner shaft via an intermediate component fixed in rotation to the drive shaft, for example a cam lobe or a sensor ring.

One or more compliant members may be housed inside one of the camshaft bearings, between two adjacent cam lobes, or in a bore of the outer tube.

BRIEF DESCRIPTION OF THE DRAWINGS

The invention will now be described further, by way of example, with reference to the accompanying drawings, in which:

FIG. 1 is a partially exploded perspective view of an SCP camshaft of a first embodiment of the invention, FIG. 2A side view of the camshaft of FIG. 1, FIG. 2B is an end view of the camshaft of FIG. 1, FIG. 3A is a section on the line A—A in FIG. 2A, FIG. 3B is a section on the line B—B in FIG. 3A.

DETAILED DESCRIPTION OF THE PREFERRED EMBODIMENTS

Figure 4:
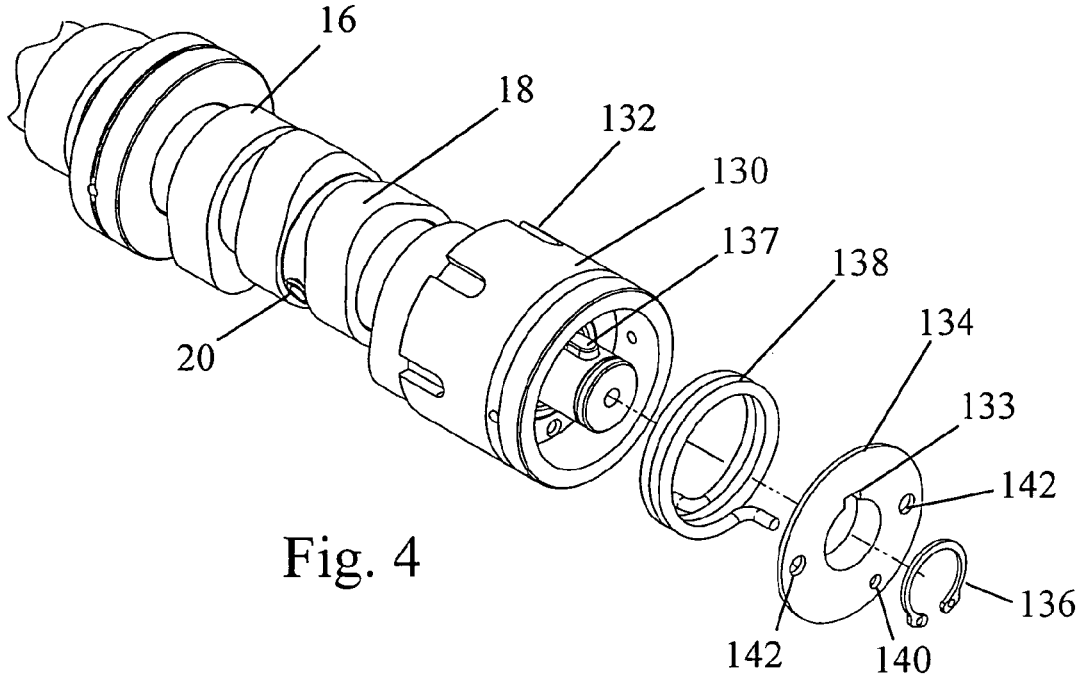
FIG. 4 is a partial perspective view of a second embodiment of the invention.

Throughout the drawings, like parts in the different embodiments have been allocated the same reference numerals and modified components serving the same function have been allocated reference numerals differing from one another by multiples of one hundred.

FIGS. 1 to 3 show an SCP camshaft 10 connected at its front end to drive sprocket 11 which incorporates a vane-type phaser. The principle of operation of an SCP camshaft and a vane-type phaser are both known and well documented in the prior art and they need not therefore be described herein in detail. It suffices in the present context to understand that the SCP camshaft is formed of an inner shaft 12 and an outer tube 14 that can be rotated relative to one another through a limited angular range by means of the phaser 11. The outer tube 14 carries two groups of lobes of which the first group of lobes 16 is fast in rotation with the outer tube 14 and the second group 18 can rotate on the outer surface of the outer tube 14 and is connected for rotation with the inner shaft 12 by means of pins 20 that pass with clearance through circumferentially elongated slots in the outer tube 14. When the inner shaft 12 is rotated relative to the outer tube 14, the two groups of lobes rotate relative to one another and thereby vary the timing of valve operated by the respective cam lobes.

It is desirable in such a camshaft to provide a spring to bias the inner shaft 12 relative to the outer tube 14 towards one angular position establishing suitable valve timing conditions for the engine to start and to idle until sufficient hydraulic pressure has been built up to enable the phaser 11 to function correctly. Hitherto, such a spring has been incorporated into the phaser 11 but, because space within a phaser is at a premium, the present invention incorporates a biasing spring in the camshaft, the different embodiments illustrated in the drawings showing various methods by which this may be achieved.

In the embodiment of FIGS. 1 to 3, a bearing sleeve 30 having slots 32 to allow it to form part of an angular position sensor is mounted at one end for rotation with the outer tube 14 of the camshaft. A helical torsion spring 38 has its axially outer end bent radially inwards and its opposite end bent to projecting axially from the coil of the spring. The axially projecting end is received in a hole in the sleeve 30 while the radially bent end is received in a radial slot 35 in the end of the inner shaft 12. An end plate 34 fitted over the end of the inner shaft 12 and retained on it by means of a circlip 36 serves to hold the spring 38 in position within the sleeve 30 and also prevents the sleeve 30 and the outer tube 14 from moving axially and sliding off the end of the inner shaft 12.

Figure 5:
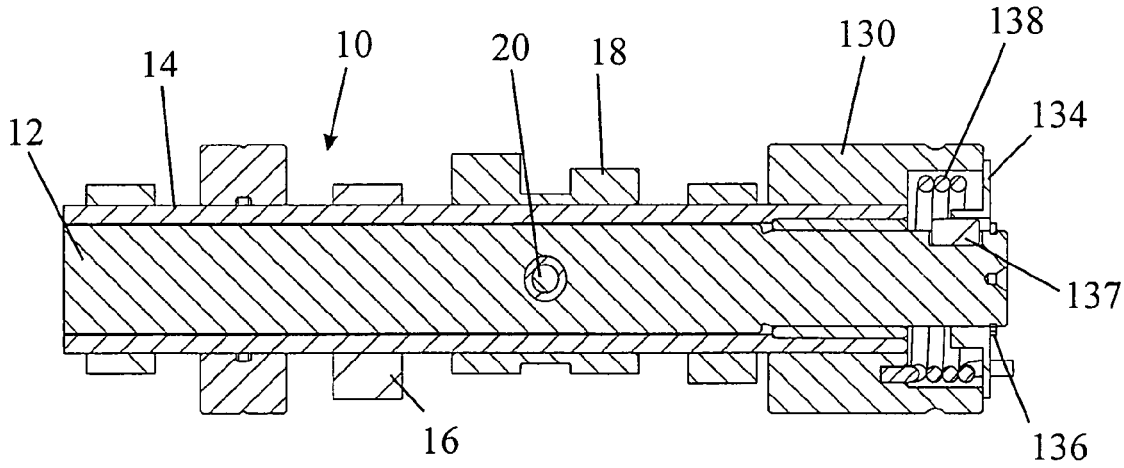
FIG. 5 is an axial section through one end of the camshaft of FIG. 4.

The embodiment of FIGS. 4 and 5 differs from that of the previous figures in that the end plate 134 has a notch 133 engaged by a key 137 inserted into the inner shaft 12 so that the end plate 134 is fast in rotation with the inner shaft. In this case, the spring 138 has two axially projecting ends one engaging as previously in a hole in the sleeve 132 and the other engaging in a hole 140 in the end plate 134. The end plate 134 also has two diametrically opposed holes 142 to be engaged by an assembly tool.

To assemble the camshaft of FIGS. 4 and 5, the ends of the spring 138 are engaged in the holes in the sleeve 132 and the end plate 134 while the notch 133 in the end plate 134 is misaligned with the key 137. The plate 134, while gripped using the holes 142, is then turned to align the notch 133 with the key 137 and pretension the spring 138. After the plate 134 has been engaged over the key 137, the circlip 136 is fitted into an annular slot in the inner shaft 12 to retain the spring 138 in position and once again prevent the outer tube 14 from moving axially relative to the inner shaft 12.

Figure 6:
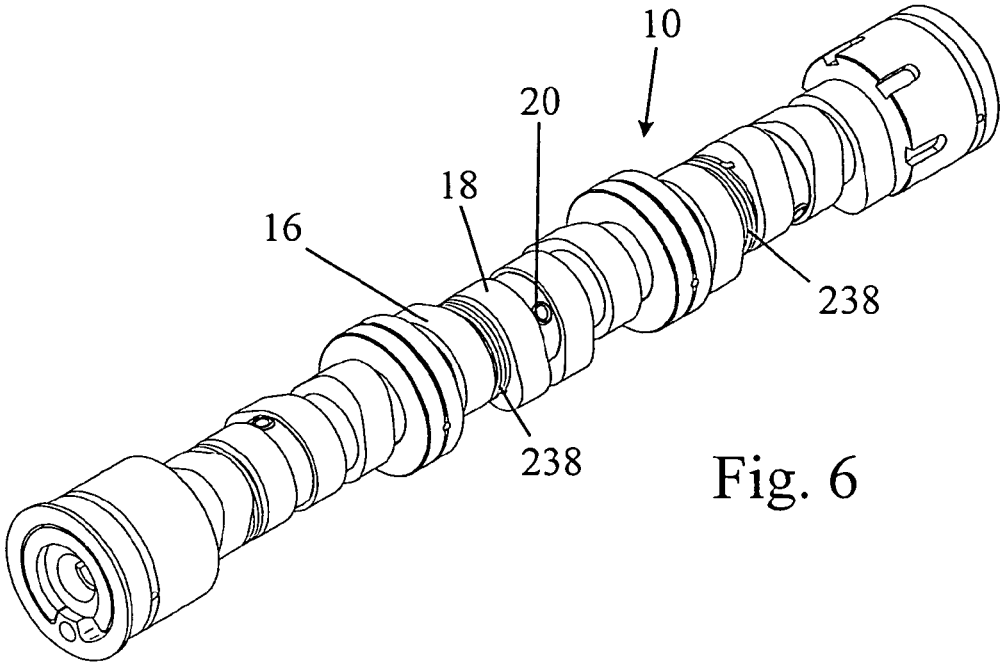
FIG. 6 is a perspective view of a third embodiment of the invention.
Figure 7:
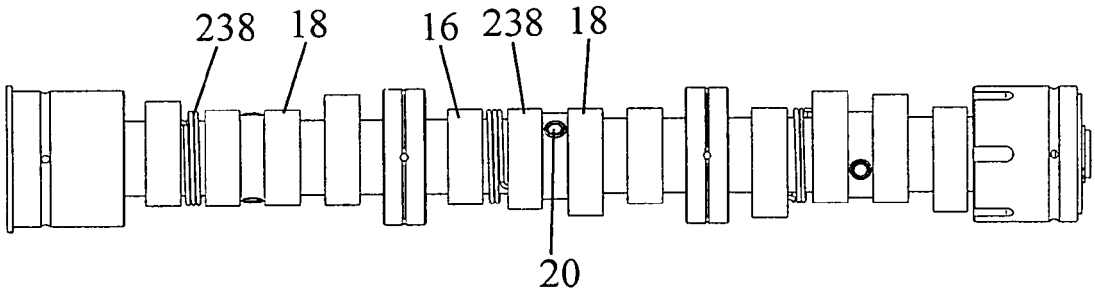
FIG. 7 is a side view of the camshaft shown in FIG. 6.

In the embodiment of FIGS. 6 and 7, several springs 238 are used to bias the inner shaft relative to the outer tube. The springs have axially projecting ends that engage directly in holes in the cam lobes of the different groups 16 and 18 that rotate with the outer tube and the inner shift, respectively, of the SCP camshaft. Clearly these springs 238 can individually be more compact and use a smaller wire diameter than an equivalent single spring.

Figure 8A:
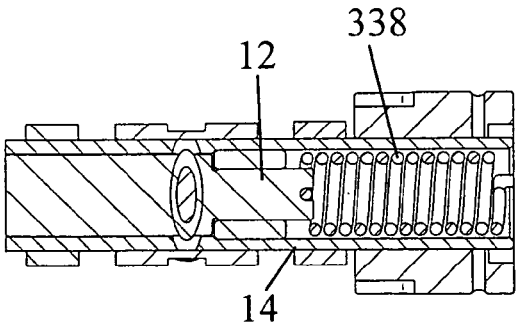
FIG. 8A is a section similar to that of FIG. 5 shown in a fourth embodiment of the invention, taken along the line VIII—VIII in FIG. 8B.
Figure 8B:
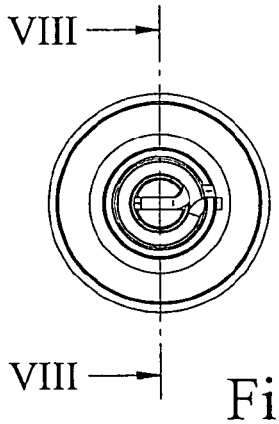
FIG. 8B is an end view of the camshaft of FIG. 8A.

In the embodiment shown in FIGS. 8A and 8B, the spring 338 is located inside the rear of the camshaft outer tube and the length of the inner shaft is reduced in order to make space for the spring.

Figure 9:
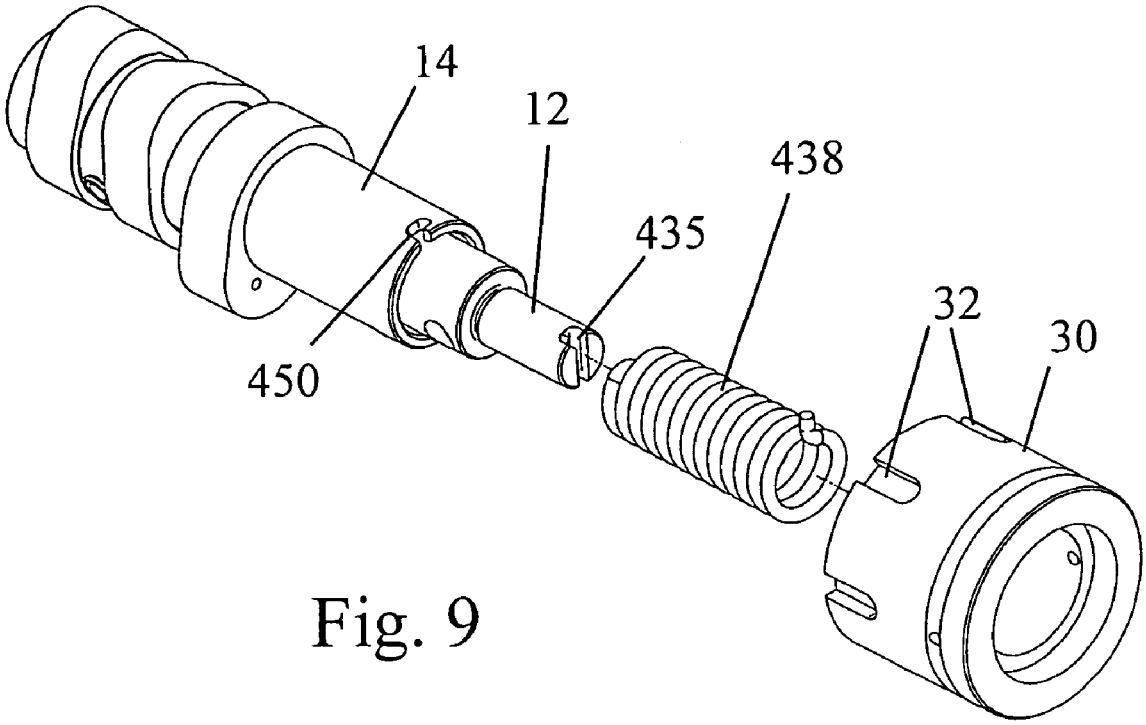
FIG. 9 shows a method by which a spring may be connected to the inner shaft and outer tube of an SCP camshaft.

FIG. 9 shows the method by which a return spring may be connected to the inner drive shaft and the camshaft tube. The drive shaft 12 is machined with a slot 435 to engage with the spring 438, whilst the tube has a slot 450 that acts as a 'bayonet' fitting in order to retain the spring in position.

Figure 10:
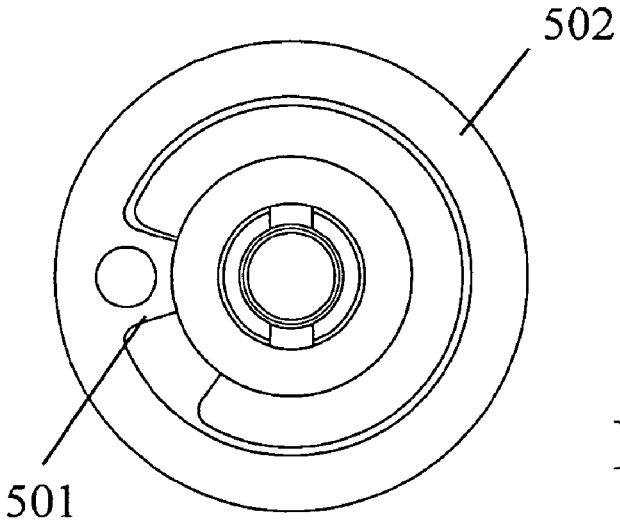
FIG. 10 is a view of the front end of a camshaft having an integrated stop to limit the degree of angular movement of the inner shaft relative to the outer tube.

All of these return spring embodiments described above require a physical stop to limit the angular motion of the SCP camshaft. FIG. 10 shows how an angular position stop 501 may be integrated into a bearing sleeve fitted to the front of the camshaft.

It is also important in all the above embodiments for the outer tube of the camshaft not to move axially relative to the inner shaft and in addition to the plates that act as end stops it is possible to provide a spring or other compliant member to bias the two apart in an axial direction.

The invention claimed is:

1. A camshaft assembly comprising an inner shaft, an outer tube surrounding and rotatable relative to the inner shaft, two groups of cam lobes mounted on the outer tube, the first group of cam lobes being fast in rotation with the outer tube and the second group being rotatably mounted on the outer tube and connected for rotation with the inner shaft by means of pins that pass with clearance through slots in the outer tube, means for securing the camshaft assembly to a phaser for effecting relative angular movement between the outer tube and the inner shaft through a limited angular range, and a compliant member incorporated in the camshaft assembly and axially spaced along the camshaft assembly from the securing means to bias the inner shaft relative to the outer tube towards one extreme of its angular range.

2. A camshaft assembly as claimed in claim 1, wherein the compliant member is a spring.

3. A camshaft assembly as claimed in claim 2, wherein the spring is connected to the outer tube via a camshaft bearing.

4. A camshaft assembly as claimed in claim 2, wherein the spring is connected to the outer tube via a camshaft lobe.

5. A camshaft assembly as claimed in claim 2, wherein the spring is connected to the outer tube via a sensor ring.

6. A camshaft assembly as claimed in claim 1, wherein the spring is connected to the inner shaft via an intermediate component fixed in rotation to the inner shaft.

7. A camshaft assembly as claimed in claim 6, wherein the intermediate component is a cam lobe.

8. A camshaft assembly as claimed in claim 6, wherein the intermediate component is a sensor ring.

9. A camshaft assembly as claimed in claim 1, wherein one or more compliant members are housed inside one of the camshaft bearings.

10. A camshaft assembly as claimed in claim 1, wherein one or more compliant members are located between two adjacent cam lobes.

11. A camshaft assembly as claimed in claim 1, wherein a compliant member is located in the bore of the outer tube.

12. A camshaft assembly as claimed in claim 11, wherein the compliant member is retained in the bore of the outer rube by a 'bayonet' fitting.

13. A camshaft assembly as claimed in claim 1, wherein a compliant member acts to bias the inner shaft position axially so as to control its location within the outer tube.

14. A camshaft assembly as claimed in claim 1, wherein a stop is provided to limit the angular motion of the inner shaft within the outer tube and prevent contact between the cam lobe connecting pins and their clearance slots through the outer tube.

15. A camshaft assembly comprising an inner shaft, an outer tube surrounding and rotatable relative to the inner shaft, and two groups of cam lobes mounted on the outer tube, the first group of cam lobes being fast in rotation with the outer tube and the second group being rotatably mounted on the outer tube and connected for rotation with the inner shaft by means of pins that pass with clearance through slots in the outer tube, wherein a torsionally compliant member is incorporated in the camshaft assembly to bias the inner shaft relative to the outer tube towards one extreme of its angular range, the torsionally compliant member having its torsion axis substantially coincident with the rotational axis of the outer tube.

16. A camshaft assembly as claimed in claim 15, wherein the compliant member is a helical spring.

17. A camshaft assembly as claimed in claim 16, wherein the spring is connected to the outer tube via a camshaft bearing, a camshaft lobe, a sensor ring, or an intermediate component fixed in rotation to che inner shaft.

18. A camshaft assembly as claimed in claim 16, wherein the helical spring acts to bias the inner shaft position axially so as to control its location within the outer tube.

19. A camshaft assembly as claimed in claim 15, wherein the camshaft has at least one camshaft bearing and the compliant member is housed inside the camshaft bearing.

20. A camshaft assembly as claimed in claim 15, wherein one or more compliant members are located between two adjacent cam lobes.

21. A camshaft assembly as claimed in claim 15, wherein the compliant member is located in the bore of the outer tube and is retained in the bore of the outer tube by a 'bayonet' fitting.

* * * * *